US012098002B2

(12) United States Patent
Todjar Hengami

(10) Patent No.: US 12,098,002 B2
(45) **Date of Patent: *Sep. 24, 2024**

(54) DUAL COMPARTMENT DISPENSING BOX WITH TOP SLIDE OPENINGS

(71) Applicant: David Todjar Hengami, Torrance, CA (US)

(72) Inventor: David Todjar Hengami, Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/328,906

(22) Filed: Jun. 5, 2023

(65) Prior Publication Data

US 2023/0312167 A1 Oct. 5, 2023

Related U.S. Application Data

(63) Continuation of application No. 17/567,344, filed on Jan. 3, 2022, now Pat. No. 11,667,431, and a (Continued)

(51) Int. Cl.
*B65D 5/72* (2006.01)
*B65D 5/48* (2006.01)

(52) U.S. Cl.
CPC ..... *B65D 5/723* (2013.01); *B65D 5/48014* (2013.01)

(58) Field of Classification Search
CPC ..... B65D 5/48014; B65D 5/723; B65D 85/60

(Continued)

(56) References Cited

U.S. PATENT DOCUMENTS 1,543,953 A 6/1925 Rothschild
1,951,274 A 3/1934 Denman (Continued)

FOREIGN PATENT DOCUMENTS

CN 204399639 6/2015
DE 10044018 3/2002

(Continued)

OTHER PUBLICATIONS

PCT/US2011/021014. International Search Report and Written Opinion dated Jan. 12, 2011. 9 pages.

(Continued)

*Primary Examiner* — Nathan J Newhouse
*Assistant Examiner* — Phillip D Schmidt
(74) *Attorney, Agent, or Firm* — Concourse Law Group; Katherine B. Sales, Esq.

(57) ABSTRACT

A multi compartment package with slide openings for storing and dispensing two different types or flavors of solid pourable product such as candies or mints is made from a single blank having a number of panels extending lengthwise and all foldably connected. From the blank the exterior of the package is formed having a front panel and a rear panel, and the interior having two compartments. The front panel has cut outs for dispensing the pourable product, and the rear panel connects to package enclosure tabs. Each compartment has a detachably connected slide, and the slides are glued to the package enclosure tabs to seal the package. To open the package, the slides are detached and moved to expose the cut outs through which the pourable product is dispensed. Conveniently, if all the product is not immediately consumed, the slides may be closed to retain freshness.

12 Claims, 9 Drawing Sheets

Related U.S. Application Data continuation of application No. 16/354,165, filed on Mar. 14, 2019, now Pat. No. 11,220,369.

(60) Provisional application No. 62/643,115, filed on Mar. 14, 2018.

(58) Field of Classification Search
USPC ..... 229/120.02, 120.03, 120.08, 125.12, 229/125.15, 120.18, 121, 220, 129.1, 91
See application file for complete search history.

(56) References Cited

U.S. PATENT DOCUMENTS 2,000,210 A 5/1935 Bayless
2,330,926 A 10/1943 Rous
2,342,081 A 2/1944 Kirkland et al.
2,349,748 A 5/1944 Otto
2,507,430 A 5/1950 Yancey
2,857,881 A 10/1958 Beebe
2,903,175 A 9/1959 Peimer
2,950,851 A 8/1960 Peimer
2,983,421 A 5/1961 Turpin
2,983,424 A 5/1961 Glass
3,009,565 A 11/1961 Leone
3,016,178 A 1/1962 Knocks
3,033,436 A 5/1962 Peimer
3,040,953 A 6/1962 Tindall
3,079,062 A 2/1963 Craddock
3,082,929 A 3/1963 Aquino et al.
3,115,290 A * 12/1963 Byassee ..... B65D 5/48014 229/120.24
3,126,141 A 3/1964 Walter
3,229,888 A 1/1966 Gillam
3,438,482 A 4/1969 Hamilton
3,441,125 A 4/1969 Small
3,539,089 A 11/1970 Osberg
3,610,510 A 10/1971 Lowry
3,669,336 A 6/1972 Robinson
3,819,093 A 6/1974 Forbes
3,907,108 A 9/1975 Weimer
4,054,203 A 10/1977 Farquhar
4,063,679 A 12/1977 Henry
4,081,128 A 3/1978 O'Neill
4,094,456 A 6/1978 Roccaforte
4,141,485 A 2/1979 Lambert
4,197,985 A 4/1980 Austin
4,201,329 A 5/1980 Roccaforte
4,274,578 A 6/1981 Montealegre
4,349,105 A 9/1982 Bradley et al.
4,361,270 A 11/1982 Roccaforte
4,438,848 A 3/1984 Montealegre
4,452,355 A 6/1984 Benham
4,548,318 A 10/1985 Boyle
4,609,142 A 9/1986 Adamek
5,040,721 A 8/1991 Essack
D319,976 S 9/1991 Wortley et al.
D320,935 S 10/1991 Nylander
5,056,708 A * 10/1991 Boyle ..... B65D 5/48014 229/120.18
5,135,158 A * 8/1992 Boyle ..... B65D 5/701 229/102
5,145,070 A 9/1992 Pallett et al.
5,197,625 A 3/1993 Mullaney
5,348,219 A 9/1994 Brintazzol
D361,262 S 8/1995 Lusker
5,465,834 A 11/1995 Sieber et al.
5,505,370 A * 4/1996 Brown ..... B65D 5/5495 229/245
5,505,373 A 4/1996 Von Stillfried
5,540,330 A 7/1996 Lo Duca
5,607,058 A 3/1997 Huesman et al.
D390,330 S 2/1998 Skaya
5,725,620 A 3/1998 Perea et al.
5,845,424 A 12/1998 Mitchell
5,918,799 A 7/1999 Walsh
5,927,498 A 7/1999 Saam
D425,413 S 5/2000 Heeley et al.
6,079,563 A 6/2000 Katchmazenski
6,116,499 A 9/2000 Hengami
6,227,440 B1 5/2001 Hart
6,273,332 B1 8/2001 Hengami
6,360,942 B2 3/2002 Hengami
D455,455 S 4/2002 Katsuyama
6,393,707 B1 5/2002 Maffei
6,394,275 B1 5/2002 Paliotta et al.
6,435,402 B1 * 8/2002 Hengami ..... B65D 5/0263 229/131.1
6,474,040 B1 11/2002 Ours et al.
6,637,646 B1 10/2003 Muise et al.
6,691,869 B2 2/2004 Knaack et al.
6,733,555 B1 5/2004 Wilder
6,889,892 B2 5/2005 Walsh et al.
D508,850 S 8/2005 Ghini et al.
6,945,449 B2 9/2005 Hengami
6,971,524 B1 12/2005 Voswinkel
7,040,528 B2 5/2006 Hengami
7,097,043 B2 8/2006 Hsu
7,156,286 B2 1/2007 Hengami
D551,967 S 10/2007 Hengami
D552,987 S 10/2007 Magnusson
7,337,904 B2 3/2008 Hengami
D580,754 S 11/2008 An
7,494,044 B2 2/2009 Walsh et al.
7,503,475 B2 3/2009 McGowan
D594,743 S 6/2009 Lukka
7,661,578 B2 2/2010 Li
7,743,973 B2 6/2010 Hengami
7,992,764 B2 8/2011 Magnusson
8,261,964 B2 9/2012 Raupach et al.
8,499,999 B2 8/2013 Sieber et al.
8,739,969 B2 6/2014 Schuld
8,800,855 B2 8/2014 Fitzwater
8,844,797 B2 9/2014 Smith
9,085,386 B2 7/2015 Hengami
9,394,066 B2 7/2016 Hengami
9,394,076 B2 7/2016 Hengami
9,561,878 B2 2/2017 Lee et al.
9,643,749 B2 5/2017 Wagner
10,086,990 B2 10/2018 Hengami
10,899,496 B2 1/2021 Hengami
11,066,209 B2 7/2021 Hengami
11,111,052 B2 9/2021 Hengami
11,180,281 B2 11/2021 Hengami
11,186,405 B2 11/2021 Hengami
11,220,369 B2 * 1/2022 Hengami ..... B65D 5/48014
11,292,634 B2 4/2022 Hengami
11,661,232 B2 5/2023 Hengami
11,667,431 B1 6/2023 Hengami
11,691,779 B2 7/2023 Hengami
11,691,783 B1 7/2023 Hengami
2003/0217944 A1 11/2003 Belloli et al.
2003/0230498 A1 12/2003 Maute
2004/0065723 A1 * 4/2004 Hengami ..... B65D 5/723 229/125.12
2005/0061864 A1 3/2005 Lee
2005/0067476 A1 3/2005 Hengami
2005/0098616 A1 5/2005 Chang
2005/0211754 A1 9/2005 Fulcher
2006/0124709 A1 6/2006 Hengami
2007/0251848 A1 11/2007 Hengami
2007/0261990 A1 11/2007 Weston et al.
2008/0128478 A1 6/2008 Quadrelli
2008/0128480 A1 6/2008 Hengami
2011/0057024 A1 3/2011 Sieber et al.
2011/0062175 A1 3/2011 Nakamura et al.
2011/0111938 A1 5/2011 Smith
2011/0162997 A1 7/2011 Robbins et al.
2011/0168767 A1 * 7/2011 Hengami ..... B65D 5/0227 229/131.1
2013/0075462 A1 3/2013 Jones et al.
2015/0321788 A1 * 11/2015 Hengami ..... B65D 5/0227 229/122

(56) References Cited

U.S. PATENT DOCUMENTS

| | | | |
|---|---|---|---|
| 2016/0297589 | A1 | 10/2016 | You et al. |
| 2019/0144156 | A1 | 5/2019 | Hengami |
| 2021/0122519 | A1 | 4/2021 | Hengami |

FOREIGN PATENT DOCUMENTS

| | | |
|---|---|---|
| EP | 0642977 | 3/1995 |
| EP | 0732269 | 9/1996 |
| EP | 0761550 | 3/1997 |
| FR | 2799743 | 4/2001 |
| JP | 07223634 | 8/1995 |

OTHER PUBLICATIONS

PCT/US2022/34764. International Search Report and Written Opinion dated Oct. 19, 2022.
https://issuu.com/designpackaging/docs/packaging-dielines-free-book-design Packaging & Dielines: The Designer's Book of Packaging Dieline; published at least as early as Sep. 18, 2019; 2 pages.
http://samanthaleewalker.blogspot.in/2012/12/ornament-box-tutorial.html Samantha Walker's Imaginary World: Ornamental Box Tutorial; retrieved Aug. 2, 2018; 1 page.
https://www.pinterest.se/pin/15692298672213867/?lp=true Corrugated Box with internal insert #packaging; retrieved Aug. 2, 2018; 1 page.

* cited by examiner

DUAL COMPARTMENT DISPENSING BOX WITH TOP SLIDE OPENINGS

RELATED APPLICATIONS

This application is a continuation of U.S. patent application Ser. No. 17/567,344, now U.S. Pat. No. 11,667,431, titled "Dual Compartment Dispensing Box with Top Slide Openings," filed Jan. 3, 2022, which is a continuation of U.S. patent application Ser. No. 16/354,165, now U.S. Pat. No. 11,220,369, titled "Dual Compartment Dispensing Box with Top Slide Openings," filed Mar. 14, 2019, which claims priority to provisional application No. 62/643,115 filed Mar. 14, 2018 entitled "Dual Compartment Dispensing Box With Top Slide Openings," the contents of which are incorporated by reference herein in their entirety.

BACKGROUND

Major food and candy manufacturers employ high-speed packaging machineries to form, fill and seal their products' packages at production lines. These machines' speeds are based on packages produced per minute and seconds. The machines take either partially-constructed boxes or box blanks, fold and seal one end, then fill the boxes, and finally fold and seal the opposite end thereby completing the manufacturing. Such machines are frequently used for packaging a solid pourable product, mints or similar small candies being one example. To facilitate dispensing such a solid pourable product, rapid form, fill and seal boxes often incorporate re-closable openings.

One type of closable box known in the art is formed from a paperboard blank that may be rapid folded, and which offers a re-closable, sliding opening incorporated into the unassembled blank, and which is constructed during the folding process prior to sealing. Known types of closable boxes with slides include those having slides that move up and down at the top of the box and include a catch mechanism to prevent the slide from dislodging. Up to now, such boxes have been limited in that they include a convenient slide opening, but only have one opening and thus can contain only one product. The boxes are also limited in that the top end of the box is not a seal end closing, meaning enclosure occurs when the slide opening is folded into the box interior during the folding process, or the slide opening is tucked into the box interior during the folding process.

Therefore there remains a need for a box having two compartments and offering a convenient dual slide opening for easily dispensing a solid pourable or similar product, that is easy to manufacture on a mass production scale using conventional high-speed packaging machineries, and that is constructed in such a way to avoid any slide insertion step, but that incorporates multiple independently operable slide openings. There is further a need for such a box having these characteristics while also having the same appearance and handling characteristics as a conventional box, wherein the top flaps are individually lifted to individually dispense the contents according to preference, and which is made from a single sheet of blank stock. There is also a need for a box with a seal end top and bottom enclosure in which the top of the box converts from a seal end enclosure to vertical slide opening dispenser.

SUMMARY

A multi compartment package with slide openings for dispensing different types or flavors of solid pourable product is made from a single blank having a number of panels extending lengthwise and all foldably connected. From the blank the package is formed having a front panel, a rear panel and a number of compartments, the front panel having a cut out for dispensing the solid pourable product, and the rear panel foldably connected to a package enclosure tab. The package further has a slide detachably connected to each compartment, and the slides are glued or otherwise fixed to the package enclosure tabs to seal the package. To open package, the slides are detached and moved to expose the cut out in the front panel, through which the pourable product is dispensed.

The box for holding and dispensing two products may also be summarized as again having a single blank with a number of panels foldably connected together, a front panel, a rear panel and opposing side panels formed into an exterior of the box, which is foldably connected to a pair of box top flaps. The panels also form a first compartment and a second compartment in an interior of the box, each of the compartments connected to a detachable slide. Similar to above, the box top flaps and slides glued or otherwise ties together to seal the exterior of the box. And each of the slides is detachable from the interior of the box and moveable to form an opening for dispensing the two products.

DESCRIPTION

Figure 1:
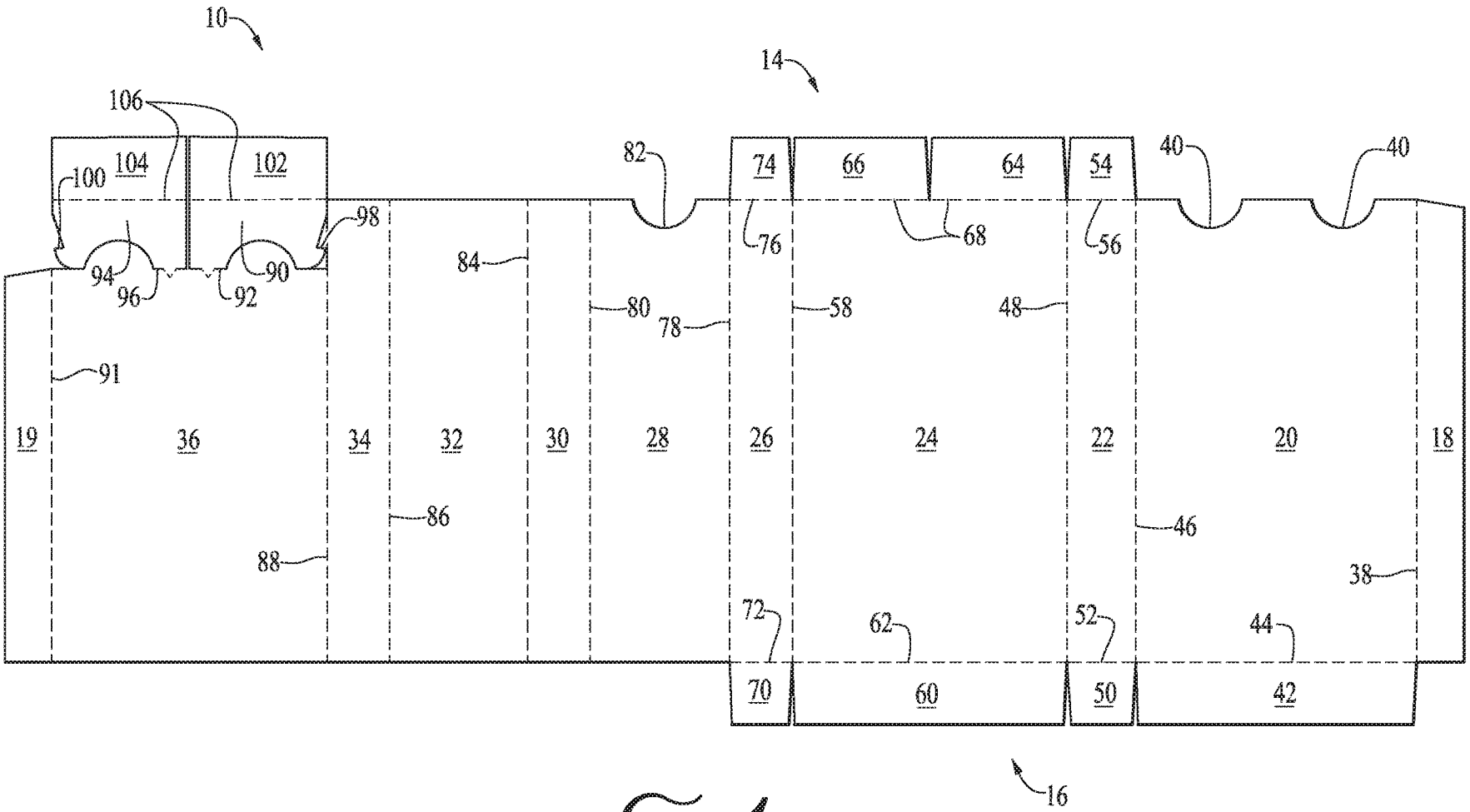
FIG. 1 shows a flat pattern view of a paperboard blank which can be folded to form a dual compartment box with dispensing mechanism.
Figure 6:
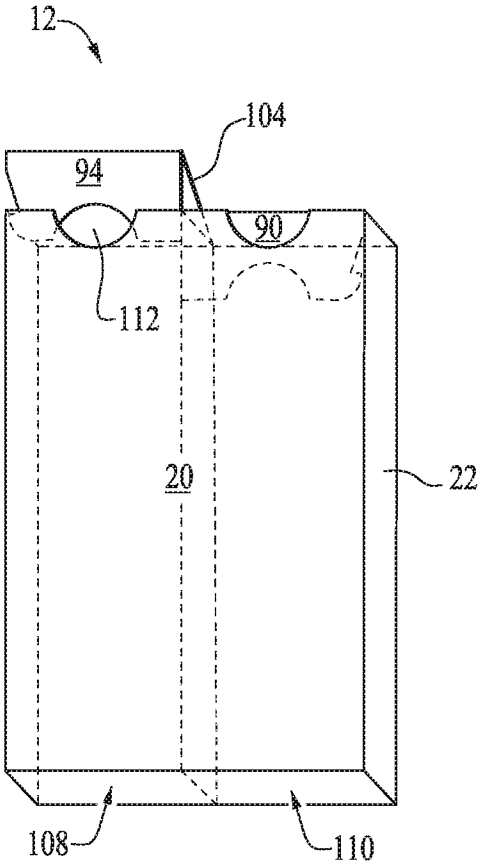
FIG. 6 is a perspective view of a fully assembled dual compartment box, showing a single slide opened for accessing one of the two compartments.
Figure 5:
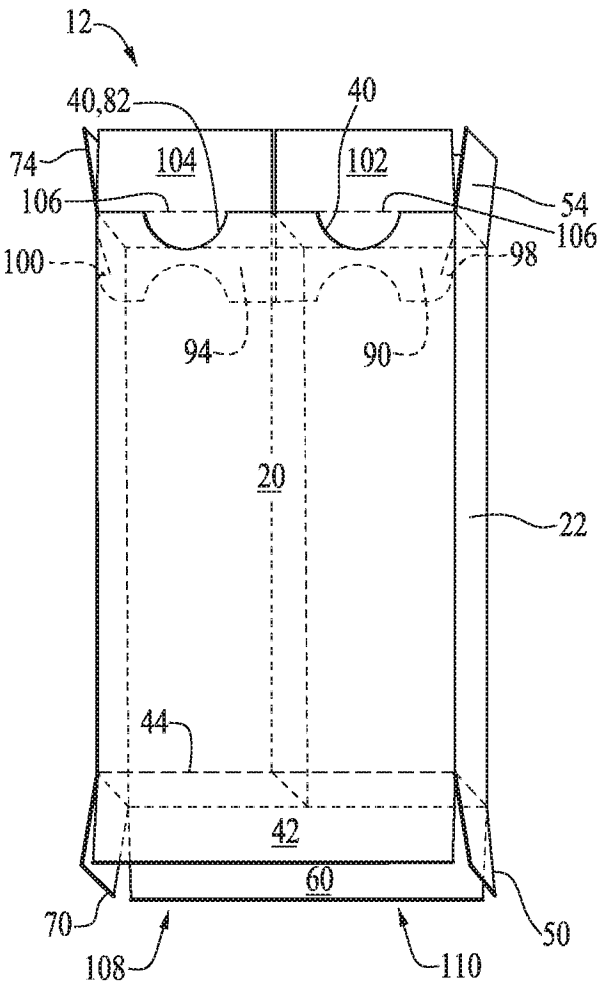
FIG. 5 is a perspective view of the dual compartment box, with the top flaps and bottom flaps open.

FIG. 1 illustrates a paperboard blank 10 that may be used to form the box 12 (FIGS. 5 and 6). The paperboard blank 10 has a top end 14 and a bottom end 16 and is scored for folding into the box 12 having a first compartment 108 and a second compartment 110 (FIGS. 5 and 6), preferably adjacent each other. Major portions of the paperboard blank 10 include an outer tab 18, front panel 20, first minor side 22, dual compartment rear panel 24, second minor side 26, first compartment front panel 28, third minor side 30, second compartment rear panel 32, fourth minor side 34, and dual compartment front panel 36, and inner tab 19 all arranged in series and preferably in a foldable relationship to one another.

Still referring to FIG. 1, the front panel 20 includes one or more peripheral cutouts 40 preferably located along at the top end 14. Although semi-circular peripheral cutouts 40 are shown in the illustrated embodiment, the peripheral cutouts 40 may be of any shape and varying sizes according to preference. A first major bottom flap 42 is connected to the front panel 20 along a front panel bottom fold line 44, the outer tab 18 is connected to the front panel 20 along an outer tab fold line 38, and the first minor side 22 is connected to the front panel 20, opposite the outer tab 18 along a first minor side fold line 46. The first minor side 22 includes a first minor bottom flap 50 connected along a first minor bottom flap fold line 52, and a first minor top flap 54 connected along a first minor top flap fold line 56. The first minor side 22 is connected to the dual compartment rear panel 24 opposite the front panel 20 along a second minor side fold line 48.

The second minor side 26 is connected to the dual compartment rear panel 24 along a third minor side fold line 58, and a second major bottom flap 60 is connected to the dual compartment rear panel 24 along a dual compartment rear panel bottom fold line 62. A first compartment top flap 66 and second compartment top flap 64 are connected to the dual compartment rear panel 24, opposite the second major bottom flap 60. Preferably, the first compartment top flap 66 and second compartment top flap 64 are adjacent one another and are foldably coupled to the dual compartment rear panel 24 along a dual compartment rear panel top fold line 68. Extending from the second minor side 26 are a second minor bottom flap 70 connected to the second minor side 26 along a second minor bottom flap fold line 72, and a second minor top flap 74 connected to the second minor side 26 along a second minor top flap fold line 76. The second minor side 26 is connected to the dual compartment front panel 28 along a first compartment inner front panel fold line 78.

The first compartment front panel 28 is connected to the third minor side 30 along a third minor side fold line 80, opposite the first compartment inner front panel fold line 78. Unlike the front panel 20 and dual compartment rear panel 24, the first compartment front panel 28 has no bottom flap, but includes a second compartment peripheral cut out 82. Preferably, the second compartment peripheral cut out 82 is larger than the peripheral cutouts 40 to ensure the second compartment peripheral cut out 82 does not interfere with dispensing a solid pourable product (not shown).

The third minor side 30 is connected to the second compartment rear panel 32 opposite the first compartment front panel 28 along a first compartment panel fold line 84. The first compartment panel 32 is connected to the compartment minor side 34 along a second compartment rear panel fold line 86. Similar to the first compartment front panel 28 and third minor side 30, the second compartment rear panel 32 lacks a bottom or top flap. The fourth minor side 34 is connected to the dual compartment front panel 36 opposite the second compartment rear panel 32 along a dual compartment inner front panel fold line 88. The dual compartment front panel 36 has no bottom flap, but includes a first compartment slide 94 and second compartment slide 90. The first compartment slide 94 is detachably connected to the dual compartment front panel 36 along a first perforated line 96 and the second compartment slide 90 is detachably connected to the dual compartment front panel 36 along a second perforated line 92.

The first compartment slide 94 also includes a first catch 98 and the second compartment slide 94 includes a second catch 100. A first compartment slide flap 104 is attached to the first compartment slide 94 opposite the dual compartment front panel 36, and a second compartment slide flap 102 is attached to the second compartment slide 90 opposite the dual compartment front panel 36. As shown in the illustrated embodiment, the first compartment slide flap 104 and second compartment slide flap 102 are foldably connected to the first compartment slide 94 and second compartment slide 90, respectively, along a dual compartment fold line 106. An inner tab 19 is connected to the dual compartment front panel 36 along a inner tab fold line 91.

Figure 2:
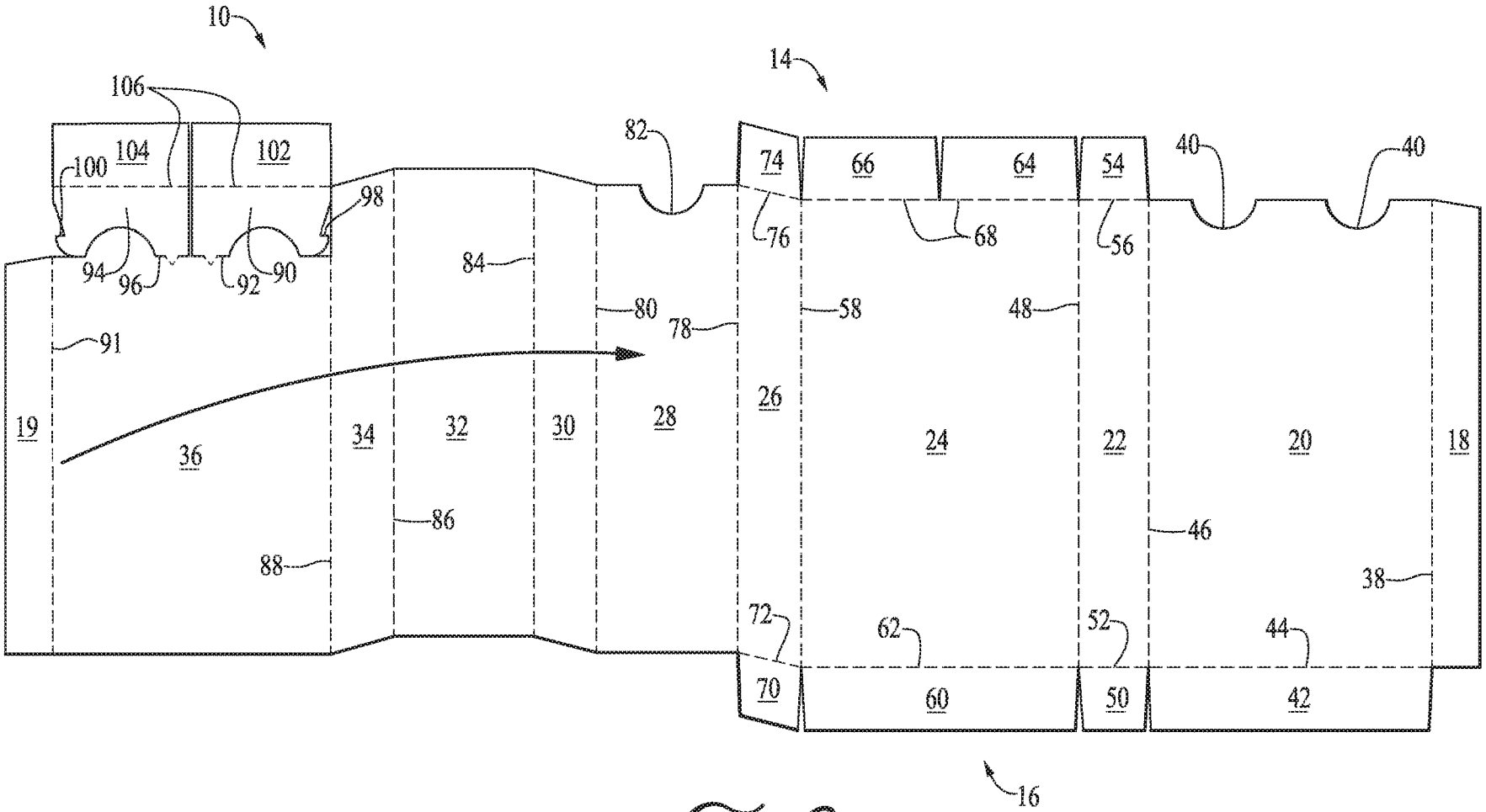
FIG. 2 is a perspective view of the paperboard blank showing a first assembly step toward forming the dual compartment box.

Referring to FIG. 2, a first stage of assembly is shown. The inner tab 19, dual compartment front panel 36, fourth minor side 34, second compartment rear panel 32, third minor side 30 and first compartment front panel 28 are being folded over. An additional assembly step may be folding the dual compartment front panel 36 relative to the fourth minor side 34 along the dual compartment inner front panel fold line 88, folding the fourth minor side 34 relative to the second compartment rear panel 32 along the second compartment minor side fold line 86, folding the second compartment rear panel 32 relative to the third minor side 30 along the second compartment rear panel fold line 84, and folding the third minor side 30 relative to the first compartment front panel 28 along the third minor side fold line 80.

Figure 3:
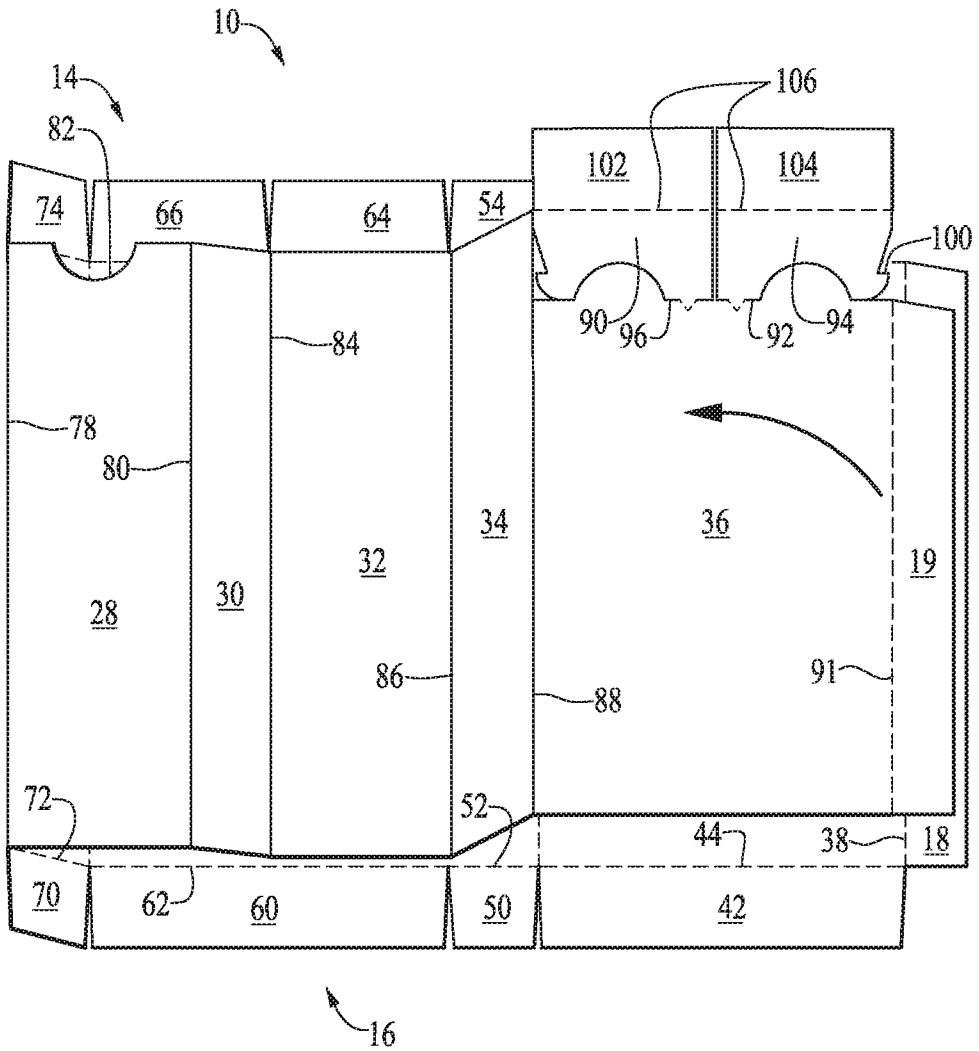
FIG. 3 is a perspective view of the paperboard blank showing a second assembly step toward forming the dual compartment box.

Referring to FIG. 3, a second stage of assembly is shown. As illustrated, the dual compartment front panel 36 is folded over the second compartment rear panel 32 and first compartment front panel 28, with the fourth minor side 34 and third minor side 30 perpendicular to the second compartment rear panel 32 and dual compartment front panel 36. In this configuration, the third minor side 30 forms a divider between the first compartment 108 and second compartment 110 (FIGS. 5 and 6). Also, when the dual compartment front panel 36 is folded over, it preferably rests against the first compartment front panel 28, and the second compartment rear panel 32 rests against the dual compartment rear panel 24. An additional assembly step may be folding the inner tab 19 perpendicular to the dual compartment rear panel 36 such that the inner tab 19 rests against the second minor side 26. Preferably, the inner tab 19 is adhesively or otherwise affixed to the second minor side 26.

Figure 4:
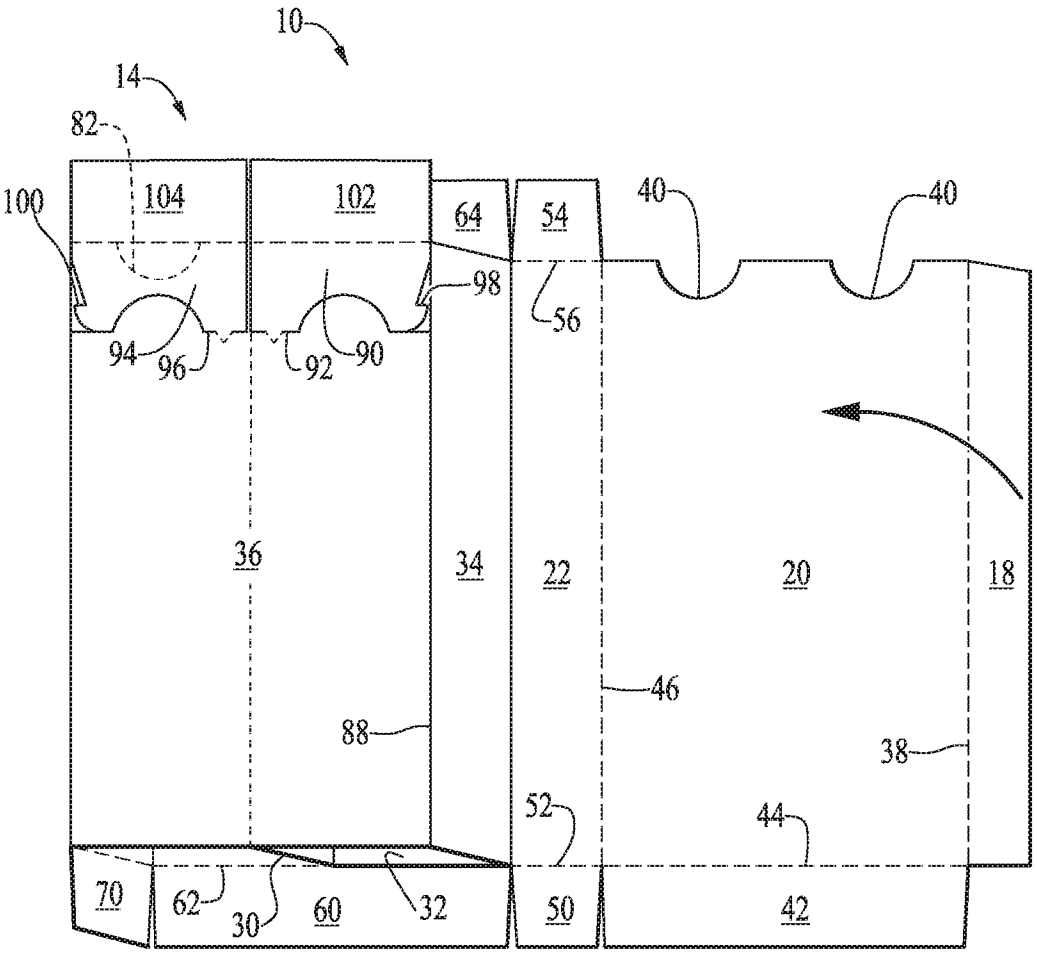
FIG. 4 is a perspective view of the paperboard blank showing a third assembly step toward forming the dual compartment box.

Referring to FIG. 4, after the dual compartment front panel 36 is folded over as shown in FIG. 3, the front panel 20 may be folded such that the first minor side 22 is adjacent the fourth minor side 34, the front panel 20 is adjacent the dual compartment front panel 36, and the outer tab 18 is folded over the inner tab 19. The outer tab 18 is preferably adhesively or otherwise affixed to the inner tab 19 to permanently form the box 12.

Referring to FIG. 5, as illustrated, the peripheral cutouts 40 on the front panel 20 are preferably sized such that there is no overlap between the peripheral cutouts 40 and the first perforated line 92 and second perforated line 96 of the dual compartment front panel 36. The front panel 20 has been folded over the dual compartment front panel 36, with the first minor side 22 overlaying the fourth minor side 34 and the outer tab 18 overlaying and affixed to the inner tab 19, thereby forming the box 12. Preferably, upon folding, the outer tab 18 and first minor side 22 are at substantial right angles from the front panel 20. The front panel 20 may be adhesively or otherwise adhered to the dual compartment front panel 36. With the front panel 20 folded over the dual compartment front panel 36, the front panel 20 covers the first compartment slide 94 and second compartment slide 90. Preferably, the first perforated line 92 and second perforated line 96 are contoured complimentary to the peripheral cutouts 40 and are disposed below the peripheral cutouts 40 such that there is no overlap between the peripheral cutouts 40 and the first perforated line 92 and second perforated line 96. In this configuration, when the first compartment slide 94 and second compartment slide 90 are detached from the dual compartment front panel 36 and oriented in a closed position, the box 12 retains any contents held therein.

Referring to FIG. 6, the box 12 is completely formed by closing the first minor bottom flap 50, second minor bottom flap 70, first major bottom flap 42, and second major bottom flap 60 in a manner similar to a conventional box. The first minor top flap 54 and second minor top flap 74 are folded over the second compartment 110 and first compartment 108, respectively. The first compartment top flap 66 and second compartment top flap 64 (FIGS. 1-3) are then folded over the second compartment 110 and first compartment 108, respectively. The first compartment slide flap 104 is then folded over and adhesively adhered or otherwise affixed to the first compartment top flap 66. Likewise, the second compartment slide flap 102, is folded over and adhesively adhered or otherwise affixed to the second compartment slide flap 64, thereby producing a closed box.

Still referring to FIG. 6, upward pressure on the first compartment slide 94 causes it to detach from the dual compartment front panel 36 along the second perforated line 96. As the first compartment slide 94 is urged upward, the second perforated line 96 clears an adjacent peripheral cutout 40 of the front panel 20, allowing a pourable product (not shown) to be dispensed from the first compartment 108. Similarly, upward pressure on the second compartment slide 90 causes it to detach from the dual compartment front panel 36 along the first perforated line 92. As the second compartment slide 90 is urged upward, the first perforated line 92 clears the adjacent peripheral cutout 40 of the front panel 20, allowing a similar or different pourable product (not shown) to be dispensed from the second compartment 100.

Figure 7:
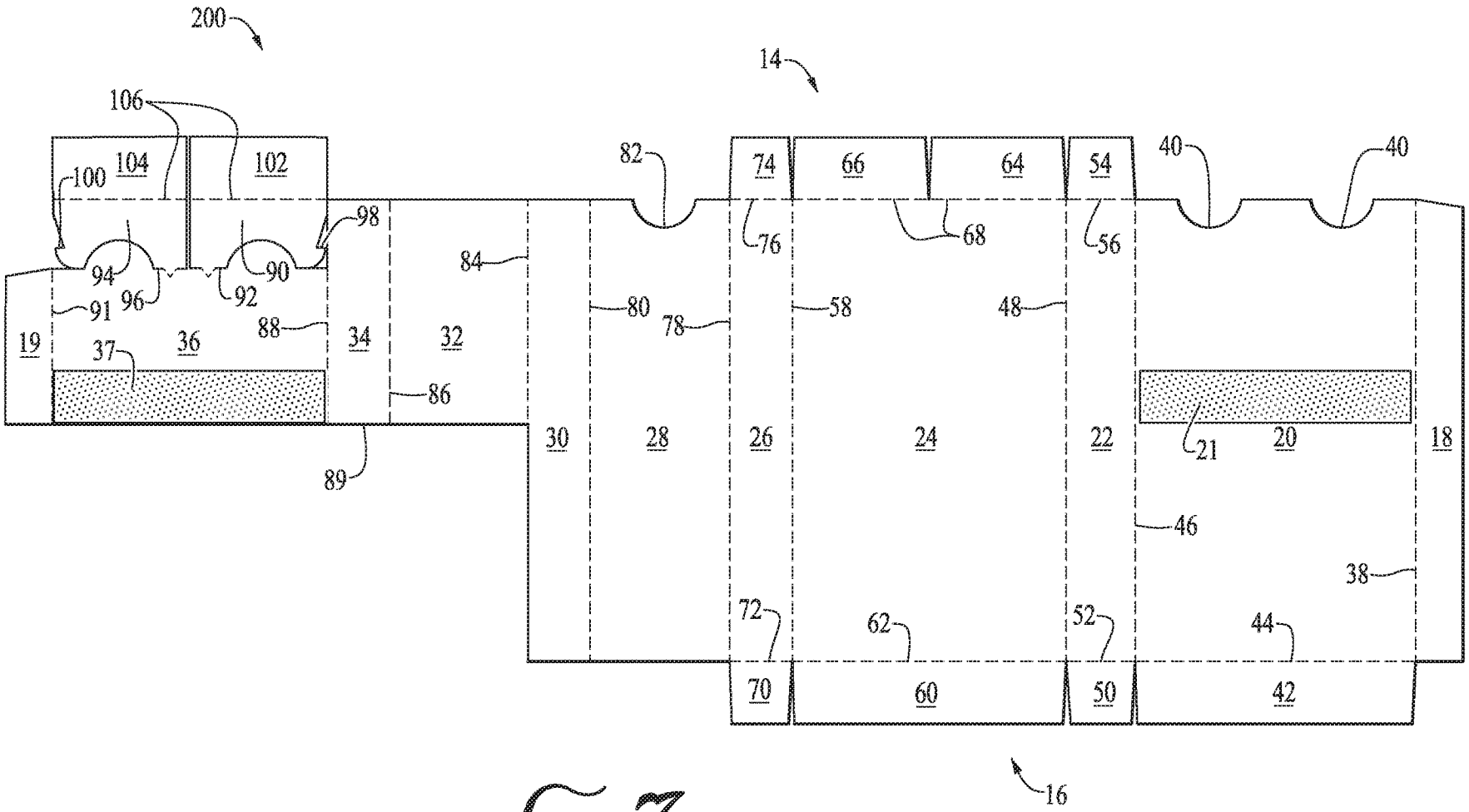
FIG. 7 shows a flat pattern view of a second embodiment of the paperboard blank which can be folded to form a dual compartment box with dispensing mechanism.

FIG. 7 illustrates a second embodiment of the paperboard blank 200 having a cut line 89 preferably across the mid-sections of the inner tab 19, dual compartment front panel 36, fourth minor side 34 and second compartment rear panel 32. A first adhesive strip 37 is located on the dual compartment front panel 36 above the cut line 89. A second adhesive strip 21 is located on the front panel 20. The first adhesive strip 37 and second adhesive strip 21 are positioned such that the second adhesive strip 21 is placed atop the first adhesive strip 37 upon the paperboard blank 10 assembly step illustrated in FIG. 10, thereby holding the box 12 together. Prior to box 12 assembly, a cut is made across the cut line 89, reducing the paperboard blank 10 size of the inner tab 19, dual compartment front panel 36, fourth minor side 34 and second compartment rear panel 32.

Figure 8:
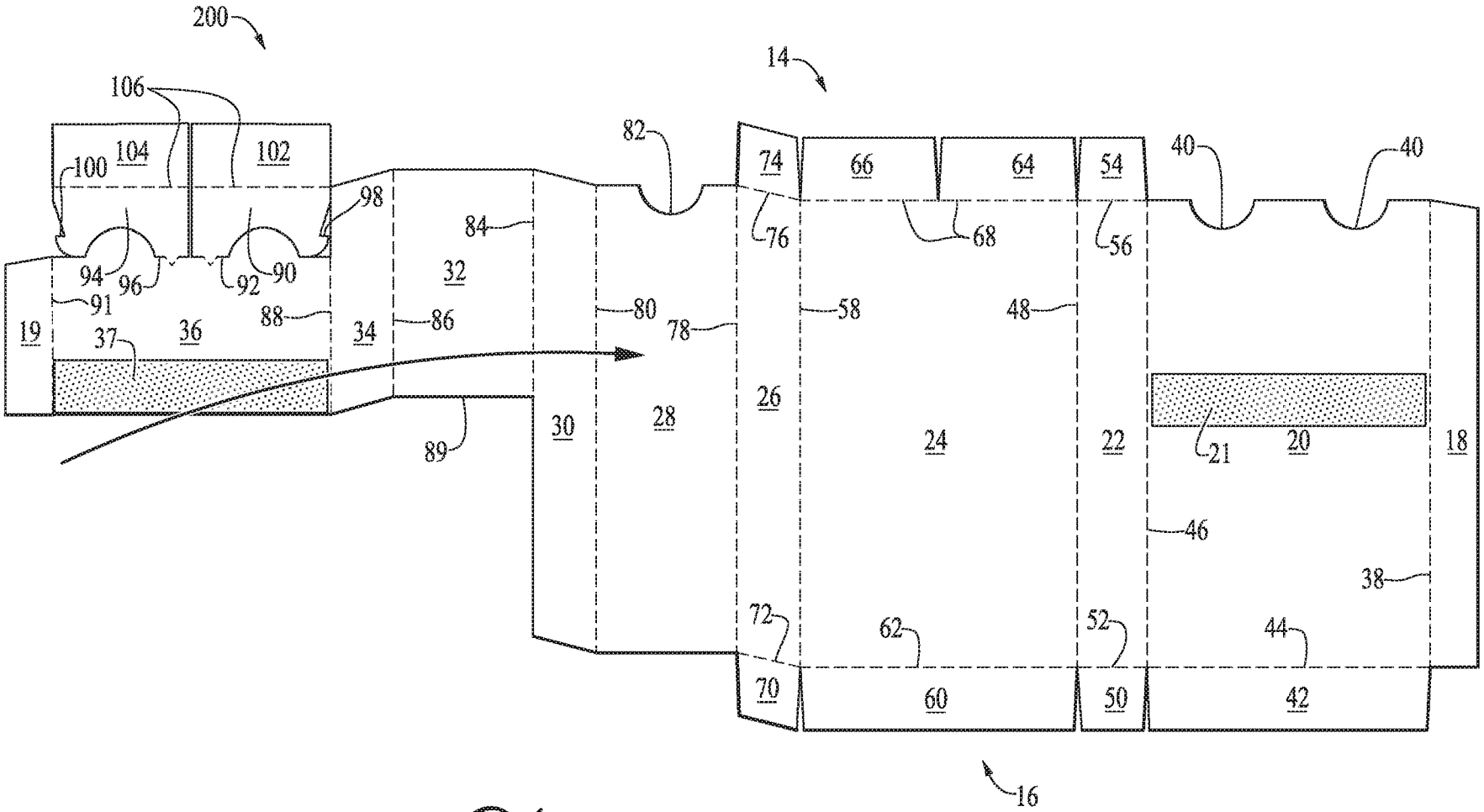
FIG. 8 is a perspective view of the second embodiment of the paperboard blank showing a first assembly step toward forming the dual compartment box.
Figure 9:
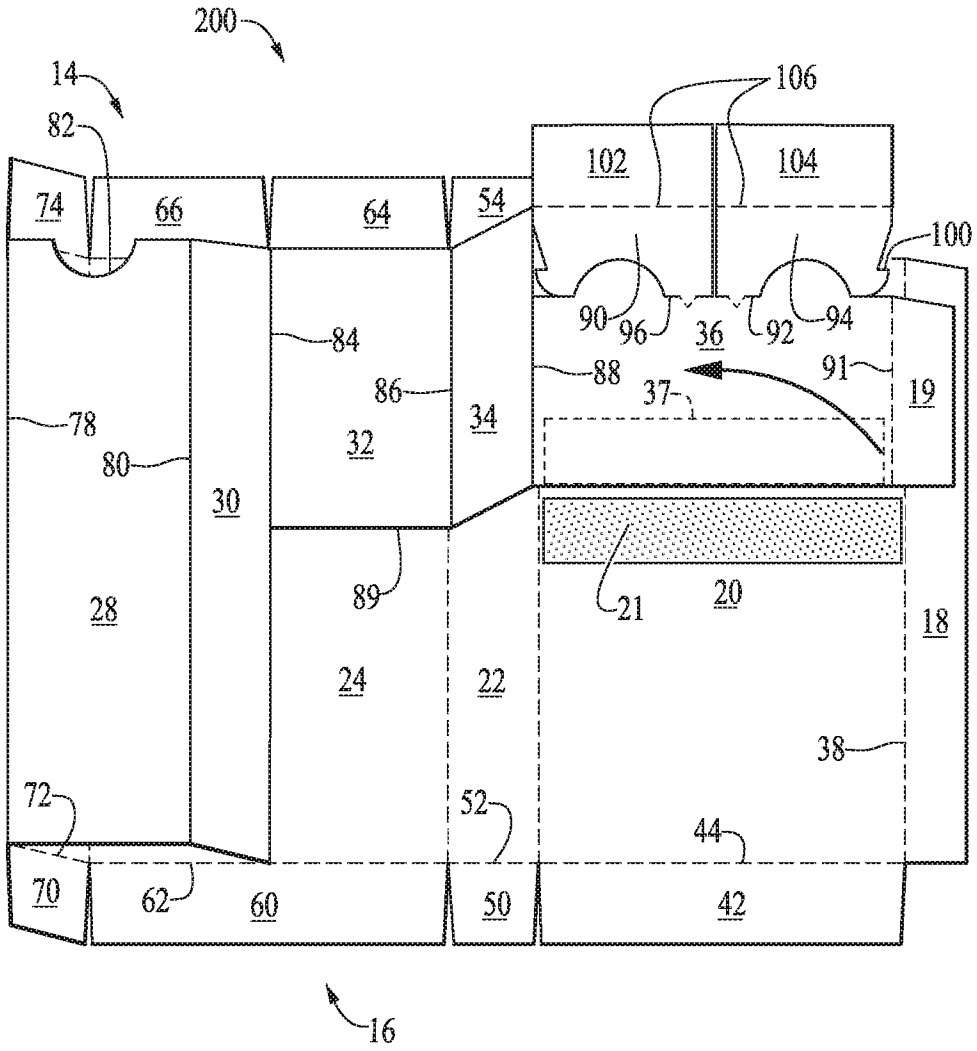
FIG. 9 is a perspective view of the second embodiment of the paperboard blank showing a second assembly step toward forming the dual compartment box.
Figure 10:
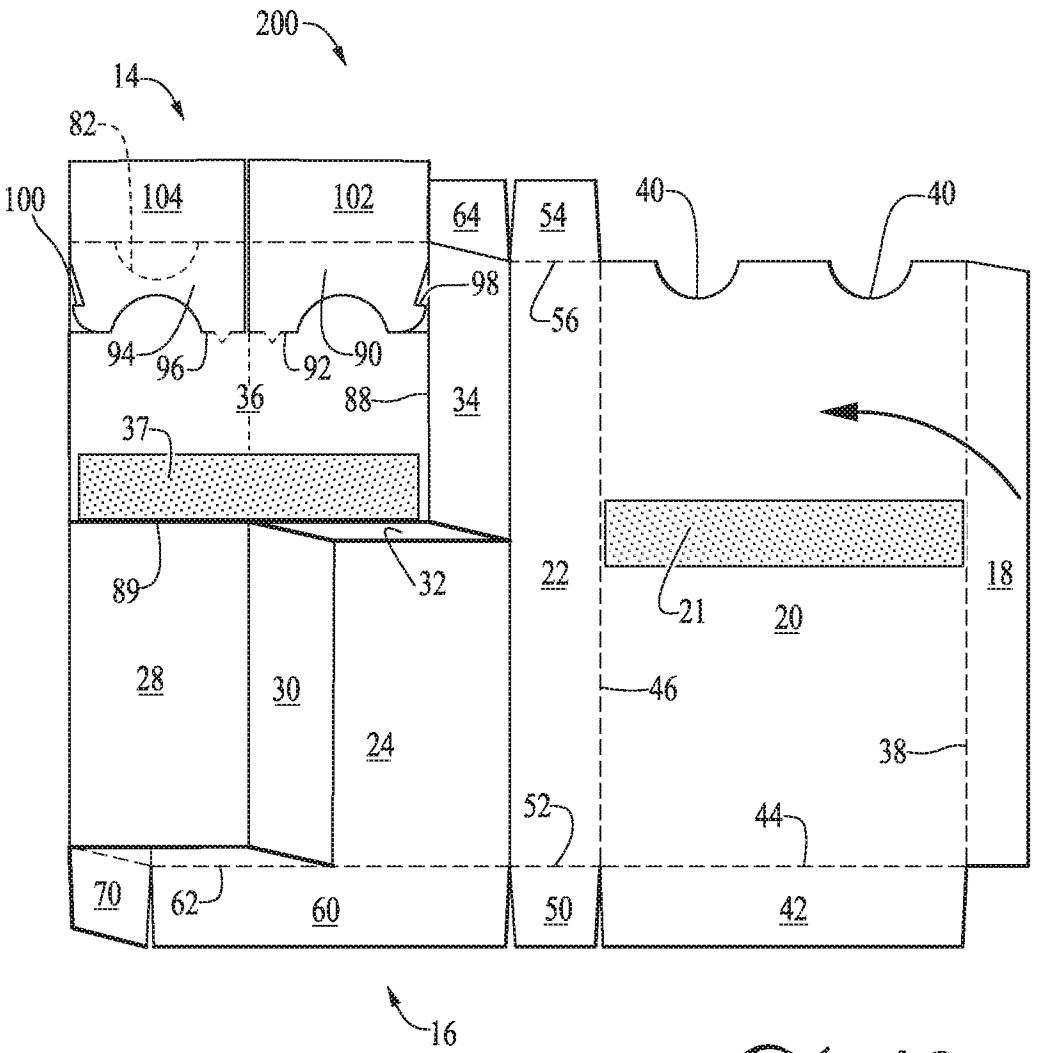
FIG. 10 is a perspective view of the second embodiment of the paperboard blank showing a third assembly step toward forming the dual compartment box.

FIGS. 8-9 illustrate the second embodiment of the paperboard blank 200 during the first, second and third assembly stages. The first and second assembly stages are the same as the first embodiment of the paperboard blank 10 (FIGS. 2-3). FIG. 10 illustrates the third assembly stage of the second embodiment of the paperboard blank 200 wherein the front panel 20 is folded over the dual compartment front panel 36 such that the first adhesive strip 37 and second adhesive strip 21 are adhesively affixed together. During the third assembly stage, the first minor side 22 is folded adjacent the fourth minor side 34 and the outer tab 18 is folded over the inner tab 19. The outer tab 18 is preferably adhesively or otherwise affixed to the second inner tab 19 to permanently form the box 120. The final assembly phases of the second embodiment of the paperboard blank 200 are the same as the first embodiment of the paperboard blank 10 (FIGS. 5-6).

The structure and function of the dual compartment dispensing box with top slide openings having been shown and described, its method of manufacture will now be discussed.

To form the box 12 from the first embodiment of the paperboard blank 10, a series of stacked paperboard blanks 10 may be assembled in a rapid folding machine (not shown). A first assembly step is folding over the dual compartment front panel 36, fourth minor side 34, second compartment rear panel 32, third minor side 30 and first compartment front panel 28 to form the first compartment 108. A final part of this step is adhesively or otherwise adhering the second compartment rear panel 24 to the dual compartment rear panel 24.

With the first compartment 108 formed and secure, a subsequent assembly step is folding the dual compartment front panel 36 over the first compartment front panel 28, including folding the second compartment minor side fold line 86 and dual compartment inner front panel fold line 88 and thus creating the second compartment 110. The inner tab 19 is folded over the second minor side 26 and adhesively or otherwise affixed thereto. Thereafter, the front panel 20, except for the portions revealed by the peripheral cutouts 40, may be folded up and over the dual compartment front panel 36 to cover the first compartment slide 94 and second compartment slide 90. Completing this process, the outer tab 18 is preferably folded over and adhesively or otherwise adhering the outer tab 18 to the inner tab 19.

With the first compartment 108 and second compartment 110 assembled, the assembly of the box 12 is substantially completed except for closing the top end 14 and bottom end 16. Closing the top end 14 requires the first minor top flap 54 and second minor top flap 74 be folded down, and the first compartment top flap 66, and second compartment top flap 64 folded over the first minor top flap 54 and second minor top flap 74, respectively. The first compartment slide flap 104 is then folded over and adhesively or otherwise adhered to the first compartment top flap 66, and the second compartment top flap 64 is also folded over with the second compartment slide flap 102 folded over and adhesively or otherwise adhered to the second compartment top flap 64. These actions may be performed for the second embodiment of the paperboard blank 200, and in series or simultaneously according to preference.

The bottom end 16 is closed in the manner of a conventional box, preferably by folding over the first minor bottom flap 50, second minor bottom flap 70, and second major bottom flap 60, and folding over and adhesively or otherwise adhering the first major bottom flap 42 to the second major bottom flap 60. The purpose of preferably folding the first major bottom flap 42 as a last step is to create a seamless appearance at the bottom end 16 when viewing the box 12 head on as it would be displayed. In alternate embodiments, the various bottom flaps 42, 50, 60, 70 may be folded in a different order according to preference. Additionally, the top end 14 or bottom end 16 may be alternatively folded first or second depending on whether the pourable products are introduced to the first compartment 108 and second compartment 110 from the top end 14 or bottom end 16 of the box 12.

While particular forms of the invention have been illustrated and described, it will also be apparent to those skilled in the art that various modifications can be made without departing from the spirit and scope of the invention. Accordingly, it is not intended that the invention be limited except by the appended claims.

Insofar as the description above and the accompanying drawings disclose any additional subject matter that is not within the scope of the claims below, the inventions are not dedicated to the public and the right to file one or more applications to claim such additional inventions is reserved.

What is claimed is:

1. A blank for forming a box having a first compartment and a second compartment, the blank comprising:

a) a second minor side panel;

b) a rear panel foldably coupled to the second minor side panel forming third minor side fold line;

c) a first minor side panel foldably coupled to the rear panel forming second minor side fold line;

d) a front panel foldably coupled to the first minor side panel forming first minor side fold line;

e) a first compartment front panel foldably coupled the second minor side panel forming a first compartment inner front panel fold line;

f) a third minor side panel foldably coupled to the first compartment front panel forming fourth minor side fold line;

g) a second compartment rear panel foldably coupled to the third minor side panel forming first compartment panel fold line;

h) a fourth minor side panel foldably coupled to the second compartment rear panel forming second compartment minor side fold line;

i) a dual compartment front panel foldably coupled to the fourth minor side panel forming inner front panel fold line; and j) a first compartment slide and a second compartment slide, wherein the first compartment slide is detachably connected to the dual compartment front panel along a first perforated line and the second compartment slide is detachably connected to the dual compartment front panel along a second perforated line;

wherein the third minor side panel forms a divider between the first compartment and the second compartment.

2. The blank of claim 1, wherein there is a first compartment slide flap foldably connected to the first compartment slide and there is a second compartment slide flap foldably connected to the second compartment slide.

3. The blank of claim 2, further comprising a first compartment top flap and a second compartment top flap foldably coupled to the rear panel forming dual compartment rear panel top fold line, wherein the first compartment top flap is configured to couple to the first compartment slide flap and the second compartment top flap is configured to couple to the second compartment slide flap, forming a seal end of the box.

4. The blank of claim 1, wherein the detachably connected slides are vertically movable within an interior of the box.

5. The blank of claim 1, wherein the first compartment front panel has a single second compartment peripheral cut out.

6. A blank for forming a box having a first compartment and a second compartment, and each compartment has slide openings for dispensing different types of solid pourable product, the blank comprising:

a) a second minor side panel having a first side edge and a second side edge;

b) a rear panel foldably coupled to the second minor side panel forming third minor side fold line;

c) a first minor side panel foldably coupled to the rear panel forming second minor side fold line;

d) a front panel foldably coupled to the first minor side panel forming first minor side fold line;

e) a first compartment front panel foldably coupled to the second minor side panel forming a first compartment inner front panel fold line;

f) a third minor side panel foldably coupled to the first compartment front panel forming fourth minor side fold line;

g) a second compartment rear panel foldably coupled to the third minor side panel forming first compartment panel fold line;

h) a fourth minor side panel foldably coupled the second compartment rear panel forming second compartment minor side fold line;

i) a dual compartment front panel having a first side edge and a second side edge, wherein the second side edge of the dual compartment front panel is coupled to the fourth minor side panel forming inner front panel fold line; and j) a first compartment slide and a second compartment slide detachably connected to the dual compartment front panel;

wherein all of the panels extend longitudinally with respect to one another, and the third minor side panel forms a divider between the first compartment and the second compartment.

7. The blank of claim 6, further comprising an outer tab coupled to the front panel along outer tab fold line.

8. The blank of claim 7, further comprising an inner tab coupled to the dual compartment front panel along inner tab fold line.

9. The blank of claim 6, wherein there is a first compartment slide flap foldably connected to the first compartment slide and there is a second compartment slide flap foldably connected to the second compartment slide.

10. The blank of claim 9, further comprising a first compartment top flap and a second compartment top flap foldably coupled to the rear panel forming dual compartment rear panel top fold line, wherein the first compartment top flap is configured to couple to the first compartment slide flap and the second compartment top flap is configured to couple to the second compartment slide flap, forming a seal end of the box.

11. The blank of claim 6, wherein the detachably connected slides are vertically movable within an interior of the box.

12. The blank of claim 6, wherein the first compartment front panel has a single second compartment peripheral cut out.

* * * * *